United States Patent [19]

Noly

[11] 4,343,406

[45] Aug. 10, 1982

[54] CONTROL APPARATUS FOR A DISTRIBUTION CRANE EQUIPPED WITH A CABLE BUCKET

[75] Inventor: Jean Noly, La Clayette, France

[73] Assignee: Potain, France

[21] Appl. No.: 62,046

[22] Filed: Jul. 30, 1979

[30] Foreign Application Priority Data

Jul. 28, 1978 [FR] France ..... 7823042

[51] Int. Cl.³ ..... B66C 3/00

[52] U.S. Cl. ..... 212/225; 74/764; 212/221

[58] Field of Search ..... 212/211, 216, 217, 225, 212/227, 214, 257, 221, 71; 74/764, 765

[56] References Cited

U.S. PATENT DOCUMENTS

| | | | |
|---|---|---|---|
| 849,257 | 4/1907 | Moss | 212/221 |
| 1,968,493 | 7/1934 | Kersting | 212/221 |
| 2,094,131 | 9/1937 | McLean | 74/764 |
| 2,548,270 | 4/1951 | Osgood | 74/764 |
| 3,043,444 | 7/1962 | Melton | 212/216 |
| 3,092,370 | 6/1963 | Kennedy | 74/764 |
| 3,572,703 | 3/1971 | Greene | 212/221 |
| 3,837,503 | 9/1974 | Komatsu | 212/221 |

*Primary Examiner*—Trygve M. Blix
*Assistant Examiner*—L. E. Williams
*Attorney, Agent, or Firm*—Remy J. VonOphem

[57] ABSTRACT

The bucket lift of a distribution crane is controlled by a device which includes a single drum hoist. A second single drum hoist is used to shut the bucket by means of two cables routed on the two pulleys located on the tip of the boom. The movement of the distribution carrier along the boom of the crane is controlled by a distribution hoist which includes two drums that are bound in rotation with the two drums of the lifting and shutting, through an epicyclic gear set. As the distribution hoist is activated, the bucket moves horizontally, thus reducing the amount of strain put on the distribution hoist, as well as the cable wear.

13 Claims, 2 Drawing Figures

CONTROL APPARATUS FOR A DISTRIBUTION CRANE EQUIPPED WITH A CABLE BUCKET

BACKGROUND OF THE INVENTION

1. Field of the Invention

The present invention pertains to a control apparatus for a distribution crane, equipped with a cable bucket.

2. Background

Whenever a cable bucket, designed for the handling of bulky materials such as sand, cement and the like, is mounted on a distribution crane without any special precaution, the following problems usually arise:

During the carrier's movement, the bucket does not move horizontally, it moves up or down.

As the carrier moves in the direction that induces the upward movement of the bucket, the translation hoist, or distribution hoist of the carrier, must first overcome the friction force, and then lift the load. This hoist should, therefore, operate so as to combine the operational characteristics of both the lifting and shutting hoists.

The above statement is based on the assumption that the lifting and shutting hoists of the bucket are mounted on the crane's boom and not directly on the distribution carrier. This last method would, indeed, cause a significant overload on the boom and should, therefore, be rejected.

This invention provides a control apparatus, which eliminates the above disadvantages.

SUMMARY OF THE INVENTION

According to the present invention, the control apparatus is designed for a distribution crane, equipped with a cable bucket. The bucket lifting and shutting cables are routed on the pulleys of the distribution carrier, then on similar pulleys located at the tip of the boom, before coiling on the lifting and shutting hoist drums, located at the boom's origin. Furthermore, the translation cables of the carrier are directly tightened between the distribution carrier and at least one drum, which can be that of the distribution hoist, or that of the translation hoist of the carrier, placed at the origin of the boom. The control apparatus is characterized by the fact, that the lifting and shutting hoist drums are bound to the drums of the distribution hoists, by an epicyclic gear set.

According to another specification of the invention, each lifting or shutting drum is coupled to an epicyclic gear set in the following manner:

The planetary gear of the set is rigidly mounted on the output shaft of the respective lifting or shutting hoist's motor. The sprocket is rigidly mounted on the respective lifting or shutting hoist's drums. The differential gears, which simultaneously mesh with the planetary gear and the sprocket, are mounted on a differential bracket which is bound in rotation to the distribution hoist drums.

According to another specification of the invention, the output shaft of the distribution hoist's motor remains permanently bound in rotation to all of the drums of that hoist, and a brake is provided to stop the above output shaft.

According to another specification of the invention, each lifting or shutting hoist includes a brake, which is used to lock the output shaft of the motor of each hoist.

According to another specification of the invention, each epicyclic gear set coupled to a lifting or shutting drum is placed inside the respective drum.

BRIEF DESCRIPTION OF THE DRAWINGS

The attached, non-scale drawing will provide a better understanding of the invention's specifications.

DESCRIPTION OF THE PREFERRED EMBODIMENT

Figure 1:
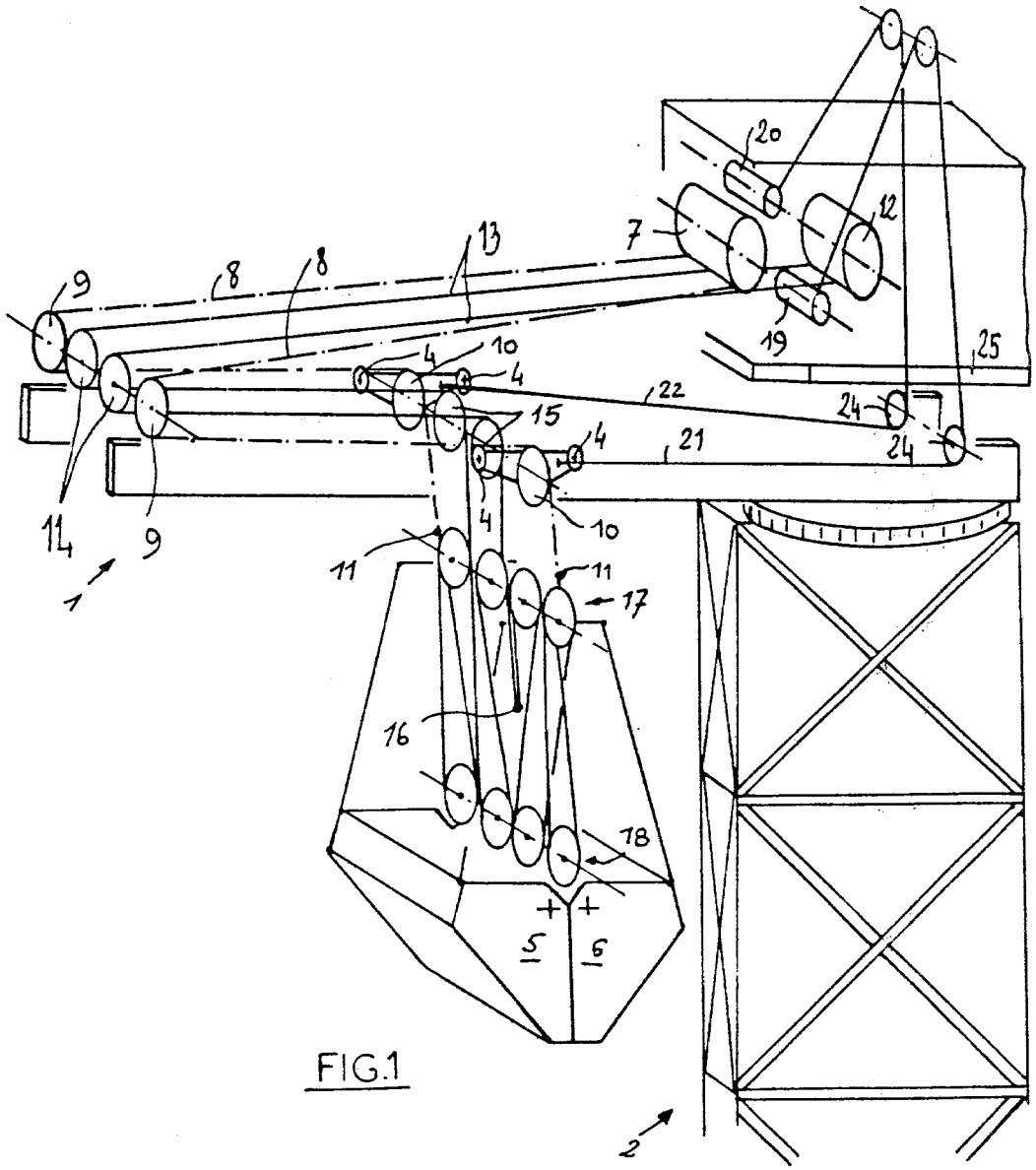
FIG. 1 is a schematic view of a distribution jib crane, equipped with a control system built to the specifications of the invention.

The figures represent a distribution crane, whose boom 1 is mounted on the mast 2. A distribution carrier 3 moves along the boom 1 in a known pattern, using four rollers 4 rolling along the longitudinal tracks of the boom. A cable bucket hangs below the carrier 3. This ordinary type bucket includes two half-jaws 5 and 6, pivoting around horizontal axles, so as to move closer or further from each other.

Three hoists are required for the movement of this part of the crane: one bucket lifting hoist, one bucket shutting hoist and one carrier translation hoist also called distribution hoist.

The lifting hoist includes a drum 7, which is used for the coiling of two cables 8. These cables are first routed on the pulleys 9 at the boom's tip, then on the pulleys 10 of the carrier 3, and they are finally attached to the bucket at the points 11.

The number of these cables is not limited, and the number of cables depends on the type of bucket and hoist used.

The shutting hoist includes a drum 12, which is used for the coiling of two cables 13. These cables are first routed on the pulleys 14 of the boom's tip, then on the pulleys 15 of the carrier 3 before they reach the bucket 5, 6, where they are attached at two points indicated by the single reference character 16. Between the pulleys 17 and 18 of the bucket, the reeving of the cables is sufficient for an adequate opening and shutting operation.

In this case also the number of these cables is not limited.

The distribution hoist includes two drums 19 and 20, which are used for the coiling of the respective cables 21 and 22. These cables are attached to the carrier 3, at two points located in the back of it. The cables 21 and 22 are pulled back under the pulleys 23 and 24, before they start running along the boom.

None of the cables of the distribution hoist are attached in front of the carrier 3. The cables 21 and 22 are used to pull back the bucket, which spontaneously moves forward under load.

Figure 2:
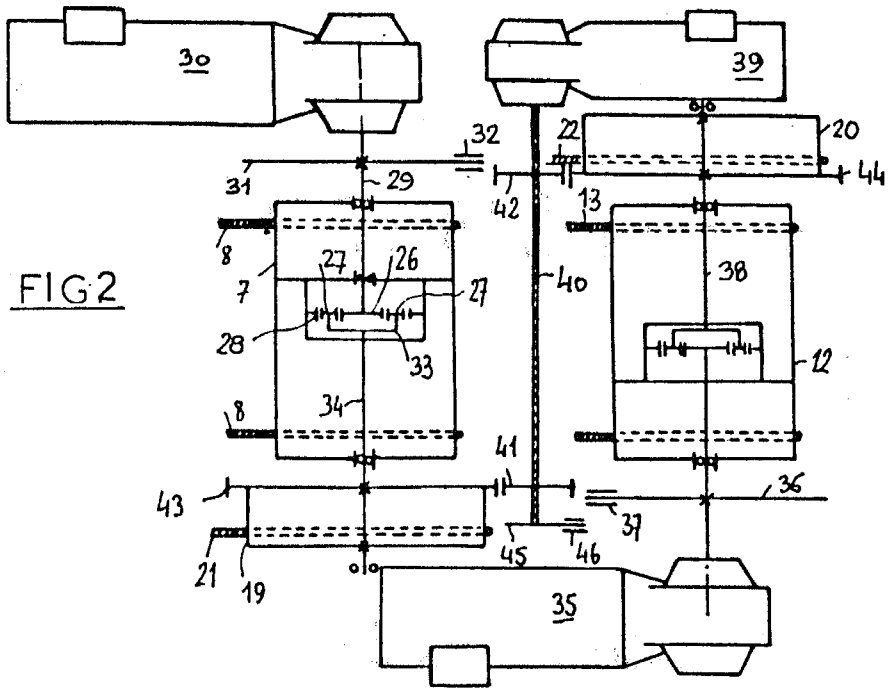
FIG. 2 is a schematic top view of this control system.

The three hoists are part of the same mechanism, which is mounted at the most desirable point of the main frame, such as at the boom support 25 at the base of the boom 1. FIG. 2 shows a detailed view of this mechanism.

As shown, the drum 7 is coaxial with the drum 19, whereas the drum 12 of the shutting hoist is coaxial with the drum 20.

The drum 7 of the lifting hoist contains a epicyclic gear set including a planetary gear 26, differential gears 27, as well as a sprocket wheel 28 rigidly mounted with the drum 7 itself. The planetary gear 26 is rigidly mounted with the output shaft 29 of the motor 30 of the lifting hoist, which, in turn, is also rigidly mounted with a disc 31 coupled to a shoe 32 to form a brake. The differential gears 27 are mounted on a differential bracket 33, which is rigidly mounted on a shaft 34 acting as a lock for the drum 19.

The drum 12 of the shutting hoist contains an epicyclic gear set, which is mounted in the same fashion as that of the drum 7. The shutting hoist includes a motor 35, whose output shaft is rigidly mounted with a brake disc 36 coupled to a shoe 37. The differential bracket of the gear set is rigidly mounted with the shaft 38, which locks the drum 20.

The carrier translation or distribution hoist includes a motor 39, whose output shaft 40 holds two pinions 41 and 42, that respectively mesh with a sprocket wheel 43 rigidly mounted with the drum 19, and a sprocket wheel 44 rigidly mounted with the drum 20. The shaft 40 is also rigidly mounted with a brake disc 45, coupled to a shoe 46.

OPERATION

1. Lifting and lowering, opening and shutting of the bucket.

As the brake 45–46 is applied, the drums 19 and 20 are locked in position, and so are the differential brackets of both epicyclic gear sets. As the brakes 31–32 and 36–37 are released, the motors 30 and 35 drive the bucket 5–6, using the cables 8 and 13. The lifting and lowering operations are accomplished in a classical way through the simultaneous operation of both hoists, the opening and shutting operations requiring only one of the two motors 30 and 35.

2. Carrier translation or distribution.

The rotation of the drums 19 and 20, driven by the motor 39, causes the carrier to move forward or backward. The rotation of these drums also causes the drums 7 and 12 to rotate by means of the epicyclic reducers. The four drums are, therefore, simultaneously activated and, by selecting the proper diameter ratio for the coiling of the cables, the following result may be obtained: the bucket remains at the same level as the carrier moves. Furthermore, all of the drums thus interconnected by the epicyclic gear sets form a balanced system. The carrier pulling cables 21 and 22 should be properly dimensioned so as to balance the lifting and retaining cables. The translation requires a relatively low torque, sufficient to counterbalance the carrier's rolling strain, as well as the incidental strain caused by the respective efficiency of the reevings, shaft line and reducers. The brakes 31–32 and 36–37 are, of course, applied during the carrier's translation.

3. Simultaneous lifting and distribution.

This mode of operation can be obtained by the simultaneous start of the three motors 30, 35, 39, and release of the three brakes. The vertical movement is controlled by the number of revolutions accomplished by the output shafts of the motors 30 and 35, whereas the horizontal movement is controlled by the number of revolutions of the drums 19 and 20. The number of revolutions of the drums 7 and 12 represents the sum or the difference (depending on the selected direction) of the revolutions of the drums 19 and 20, and of the output shafts of the motors 30 and 35.

This invention applies to any apparatus used to control the operation of a cable bucket, hanging from a mobile carrier, the lifting and shutting cables being directly attached to the bucket, whereas the hoist assembly is supported by the main frame of the carrier.

In such a system, the bucket moves horizontally as the carrier is activated by four properly dimensioned drums. The translation hoist of the carrier operates at a lower efficiency, which can only counterbalance the friction.

Any change made to the mechanism represented on FIG. 2, without affecting the result, would still be covered by the field of the invention. It would, indeed, be possible to design a mechanism including only one drum and one carrier pulling cable.

The invented apparatus offers the following advantages:

It allows a direct cable drive of the bucket. The weight of the carrier and its main frame is minimal. The hoists are mounted on this frame at the most desirable point, such as the boom support for instance. The apparatus requires very few pulleys. During the translation of the carrier, its pulleys do not rotate, so as to reduce the wear of the cables.

I claim:

1. A control device for a distribution crane having a mast and a boom disposed adjacent to said mast, said boom having one end pivotally mounted to said mast, an opposite end and at least one track extending longitudinally from said one end to said opposite end, said device comprising:

a distribution carrier movably mounted on said at least one longitudinal track, said one end of said boom further being inclined vertically above said opposite end to urge said distribution carrier toward said opposite end by gravity;

a bucket suspended below said distribution crane, said bucket having a first half-jaw and a second half-jaw disposed opposite said first half-jaw for cooperative engagement therewith;

means, mounted adjacent to said one end of said boom, for moving said distribution carrier and said bucket along said longitudinal track toward said one end of said boom, said moving means including a first drum means and a second drum means mounted parallel to said first drum means, and a first motor interposed said first and second drum means, said first motor connected to said first and second drum means for rotation therewith when said first motor is activated;

first epicyclic hoist means, mounted coaxially with said first drum means, for opening and closing said first half-jaw relative to said second half-jaw of said bucket, said first epicyclic hoist means including a second motor having a shaft and a third drum means mounted to said shaft of said second motor;

second epicyclic hoist means, mounted coaxially with said second drum means, for vertically moving said bucket up and down relative to said boom independent of said first epicyclic means, said second epicyclic hoist means including a third motor having a shaft and a fourth drum means mounted to said shaft of said third motor; and means for connecting said moving means to said first and second epicyclic hoist means to simultaneously rotate said first, second, third and fourth drum means so as to maintain said bucket level relative to said boom when said distribution carrier rolls along said track.

2. A control device as claimed in claim 1 wherein said moving means further includes a first braking means for controlling the rotation of said first and second drum means.

3. A control device as claimed in claim 2 wherein said first epicyclic hoist means further includes second braking means for controlling the rotation of said third drum means.

4. A control device as claimed in claim 2 wherein said second epicyclic hoist means further includes third braking means for controlling the rotation of said fourth drum means.

5. A control device as claimed in claim 2 wherein said third drum means further comprises:

a first planetary gear rigidly mounted on said shaft of said second motor for rotation therewith;

a shutting drum member centrally mounted with respect to said shaft of said second motor;

a sprocket wheel mounted on the inside surface of said shutting drum member; and first differential gear means for coupling said second planetary gear to said sprocket wheel in order to rotate said shutting drum member thereby.

6. A control device as claimed in claim 5 wherein said fourth drum means further comprises:

a second planetary gear rigidly mounted on said shaft of said third motor for rotation therewith;

a lifting drum member centrally mounted with respect to said shaft of said third motor;

a sprocket wheel mounted on the inside surface of said lifting drum member; and second differential gear means for coupling said second planetary gear to said sprocket wheel in order to rotate said lifting drum member thereby.

7. A control device as claimed in claim 6 wherein said connecting means further comprises:

a first shaft connected to said first differential gear means, said first shaft further rotating in a direction opposite to the rotation of said first planetary gear, said first drum means further rigidly connected to said first shaft for rotation therewith; and a second shaft connected to said second differential gear means, said second shaft further rotating in a direction opposite to the rotation of said second planetary gear, said second drum means further rigidly connected to said second shaft for rotation therewith.

8. A control device as claimed in claim 7 wherein said first drum means further includes a first cable connected to said first drum means and to said distribution carrier, said first cable further being coiled around said first drum means.

9. A control device as claimed in claim 7 wherein said second drum means further includes a second cable connected to said second drum means and to said distribution carrier, said second cable further being coiled around said second drum means.

10. A control device as claimed in claim 7 wherein said third drum means further includes a first pair of cables connected to said shutting drum member and to said bucket, said first pair of cables further being coiled around said shutting drum member.

11. A control device as claimed in claim 7 wherein said fourth drum means includes a second pair of cables connected to said lifting drum member and to said bucket, said second pair of cables further being coiled around said lifting drum member.

12. A control device for a distribution crane having a mast and a boom disposed adjacent to said mast, said boom having one end pivotally mounted to said mast, an opposite end and at least one longitudinal track extending from said one end to said opposite end, a distribution carrier movably mounted on said at least one longitudinal track, a bucket suspended below said distribution carrier, said bucket having a first half-jaw and a second half-jaw opposite said first half-jaw for cooperative engagement therewith, wherein said improvement further comprises:

means, mounted adjacent to said one end of said boom, for moving said distribution carrier and said bucket along said longitudinal track toward said one end of said boom, said moving means means including a first drum means and a second drum means mounted parallel to said first drum means;

first epicyclic hoist means, mounted coaxially with said first drum means, for opening and closing said bucket, said first epicyclic hoist means including third drum means; and second epicyclic hoist means, mounted coaxially with said second drum means, for vertically moving said bucket up and down relative to said boom independent of said first epicyclic hoist means, said second epicyclic hoist means including fourth drum means.

13. In a control device as claimed in claim 12, further comprising:

means for connecting said moving means to said first and second epicyclic hoist means to simultaneously rotate said first, second, third and fourth drum means so as to maintain said bucket level relative to said boom when said moving means is activated.

* * * * *

UNITED STATES PATENT AND TRADEMARK OFFICE

CERTIFICATE OF CORRECTION

PATENT NO. : 4,343,406

DATED : August 10, 1982

INVENTOR(S) : Jean Noly

It is certified that error appears in the above-identified patent and that said Letters Patent is hereby corrected as shown below:

Line 56, Column 1: Delete "drums." and insert --- drum. ---

Line 30, Column 6: Delete "means" second occurrence

Signed and Sealed this

*Fifteenth* Day of *February 1983*

[SEAL]

*Attest:*

GERALD J. MOSSINGHOFF

*Attesting Officer*

*Commissioner of Patents and Trademarks*